United States Patent [19]

Gray

[11] Patent Number: 4,796,506

[45] Date of Patent: Jan. 10, 1989

[54] STRINGED INSTRUMENT CHORD ATTACHMENT

[76] Inventor: Gary T. Gray, P.O. Box 1593, McAlester, Okla. 74502

[21] Appl. No.: 117,871

[22] Filed: Nov. 9, 1987

[51] Int. Cl.[4] ..... G10D 3/04

[52] U.S. Cl. ..... 84/317

[58] Field of Search ..... 84/317, 318, 315, 316

[56] References Cited

U.S. PATENT DOCUMENTS

| | | | |
|---|---|---|---|
| 743,054 | 11/1903 | Bergren | 84/318 |
| 3,154,994 | 11/1964 | Blohm | 84/317 |
| 4,154,134 | 5/1979 | Schreiber | 84/317 |

*Primary Examiner*—Lawrence R. Franklin

*Attorney, Agent, or Firm*—Robert K. Rhea

[57] ABSTRACT

A device for playing chords on a stringed musical instrument by manually depressing a chord forming member extending transversely of the instrument neck. The device includes a bar clamp transversely gripping a stringed instrument neck with the topmost bar supporting a plurality of spring members projecting longitudinally of the neck toward the sound board and terminating in transversely enlarged plate end portions for non-interfering relation during movement toward and away from the neck. The spring member end portions are manually depressed individually toward the strings so that resilient pads on the undersurface of the spring members engage a selected number of strings in a string stopping chord producing action against predetermined frets on the instrument neck.

1 Claim, 1 Drawing Sheet

STRINGED INSTRUMENT CHORD ATTACHMENT

BACKGROUND OF THE INVENTION

1. Field of the Invention

This invention relates to musical instruments and more particularly to a chord selecting attachment for the neck of a finger board and fret equipped stringed musical instrument.

Musical chords are played on guitars and similar stringed instruments by depressing a selected string or a combination of strings toward the surface of the instrument neck at a selected location to effectively shorten the length of the strings and contact a desired fret by the fingers of one hand while the other hand picks or strums the strings over the sound board. This selected depression of strings achieves a desired combination of notes for sounding a chord. For example, an A chord is obtained by stopping the d, g and b strings between the first an second frets which force these strings to contact the second fret. A high degree of finger dexterity is required or must be developed to properly finger the strings in playing an instrument and it appears obvious that this would pose some problem with persons having large diameter and/or short fingers or those having a physical impairment in playing a stringed instrument.

This invention simplifies producing stringed instrument chords for such persons.

2. Description of the Prior Art

Chord playing attachments for stringed instruments are numerous, however, some of these prior art devices have a high profile making it difficult for some persons to reach chord keys. Other chord playing attachments are formed by mechanical cooperating parts often requiring semipermanent mounting on an instrument neck or requiring rails to support the attachment.

U.S. Pat. No. 3,915,051 is an example of the button pushing chord playing attachment which features a mounting and spacing brackets provided with width and thickness adjustments for different neck dimensions.

This invention provides a low profile stringed instrument neck clamp supported chord player easily operated, installed and removed from an instrument neck without the use of tools or modifying the musical instrument.

SUMMARY OF THE INVENTION

A stringed instrument neck clamp is formed by a pair of bars respectively under and overlying the instrument neck and secured by thumb screws at respective sides of the neck. The top bar supports a plurality of planar spring members in overlying spaced parallel relation with respect to the several strings. Pads, on the depending surface of the respective spring member, engages underlying strings when the spring member is depressed toward the adjacent surface of the instrument neck thus forming a selected chord.

The principal objects of this invention are to provide an economical chord playing attachment for mounting on any one of a plurality of stringed instruments which includes a unitary clamp top bar and string contacting members forming a selected chord in accordance with the respective manually depressed string contacting member and which presents a low profile for ease of operation.

DESCRIPTION OF THE PREFERRED EMBODIMENTS

Figure 2:
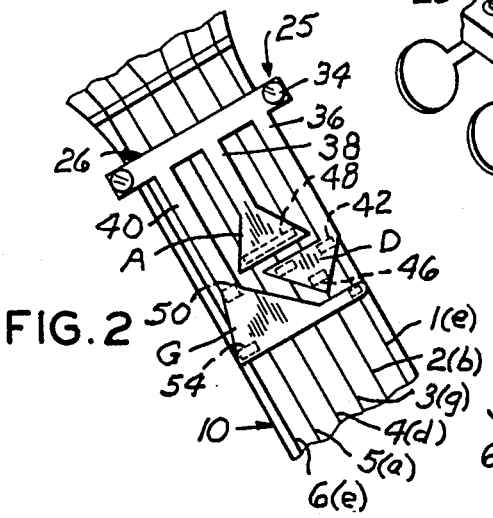
FIG. 2 is a top plan view of FIG. 1.

Like characters of reference designate like parts in those figures of the drawings in which they occur.

In the drawings:

The reference numeral 10 indicates the tuning head end portion of a guitar neck having a plurality (6) strings 12 extending longitudinally of the neck over a plurality of frets, only four being shown 14*a*, 14*b*, 14*c* and 14*d*, extending transversely of the neck in equally spaced conventional configuration. The strings 12 pass over the front bridge 16 and terminate at the tuning head 18 by winding on respective tuning pegs 20. The above description is conventional with many stringed instruments and is set forth to show the combination with which the chord selector 25 is intended to be used.

The strings 12 are further numbered 1 through 6 in combination with the respective letter identification of each string (e), (b), (g), (d), (a) and (e).

The chord selector 25 comprises a bar clamp 26 extending transversely of the neck 10 between the front bridge 16 and first fret 14*a*. The clamp 26 comprises a top bar 28 of generally rectangular configuration having a flat top surface and a bottom or base bar 30 similarly generally rectangular but characterized by a transverse concave recess 32 intermediate its length which cooperatively nests, in gripping relation, the depending surface of the neck 10. The respective end portions of the clamp bars 28 and 30 are cooperatively line drilled with the bores in the bar 30 being threaded for receiving thumb nut equipped clamp screws 34 for rigid mounting on the neck 10.

A plurality, three in the example shown, of relatively thin elongated strap-like spring members 36, 38 and 40 are uniform thickness integrally connected at one end, in substantially equally spaced relation, with the upper portion of the top bar 28 and their top flat surfaces lying in the plane of the top surface of the top bar for ease in molding the top bar and several spring members as a unit and maintaining a low profile thereof. The spring members all project laterally from the top bar longitudinally of the neck toward the sound box end, not shown, and in parallel spaced overlying relation with respect to the plane defined by the several strings 12. The end portion of the strap members 36–40, opposite the clamp bar 28, terminate in longitudinally staggered relation for the reason presently explained.

The terminal end portion of the end member 36 is transversely enlarged or extended to substantially define a triangular-shaped plate D which extends across the fret 14*c* and transversely spans the strings 1(*e*), 2(*b*) and 3(*g*).

Figure 1:
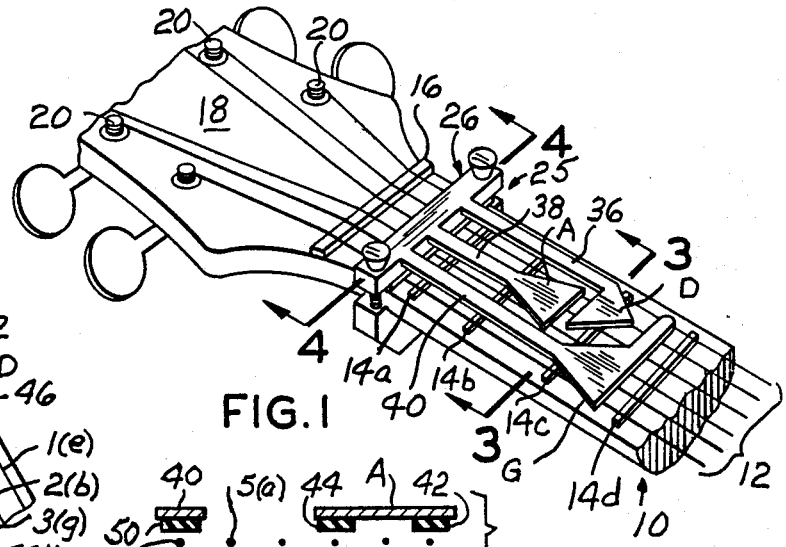
FIG. 1 is a perspective view of the device mounted on a fragment of a stringed instrument neck.
Figure 3:
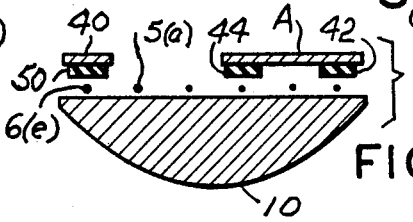
FIGS. 3 and 4 are vertical cross sectional views, to enlarged scales, taken substantially along the lines 3—3 and 4—4 of FIG. 1.
Figure 4:
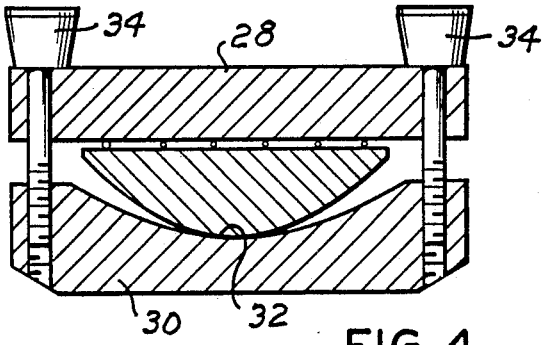
Figure 5:
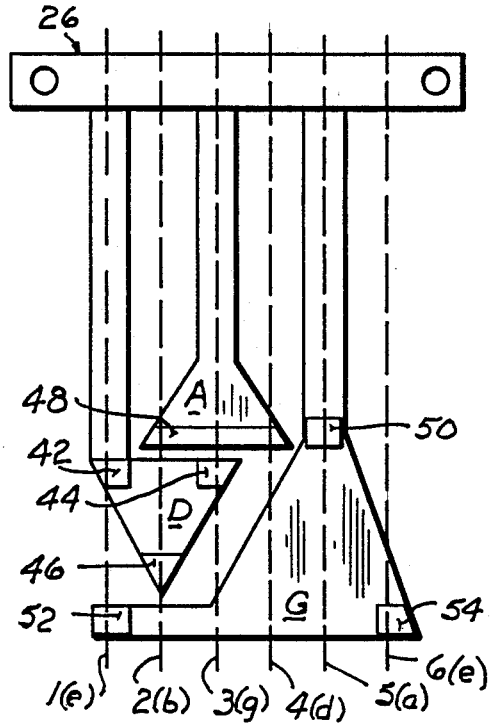
FIG. 5 is a bottom view of the chord selector shown in FIG. 2, the position of the several strings being shown by dotted lines; and, FIG. 6 is a view similar to FIG. 2 with the instrument neck omitted illustrating an alternative configuration of the chord forming spring members.

Similarly, the spring member 38 terminates in a generally triangular plate A between the frets 14(*b*) and 14(*c*) and overlying the strings 2(*b*), 3(*g*) and 4(*d*). Similarly, the spring member 40 projects longitudinally beyond the other two members 36 and 38 and is transversely enlarged to define a plate G between the frets 14(*c*) and 14(*b*) having a triangular portion with an arm projecting longitudinally from one end of its base, transversely of the neck and toward its opposite side. The plate G transversely overlies the six strings. Thus, as illustrated in FIGS. 1, 2 and 5, the enlarged terminal ends or plates D, A and G of the respective string members 36–40 may be moved vertically toward and away from the fret equipped surface of the neck 10 without interfering one with another.

Figure 6:
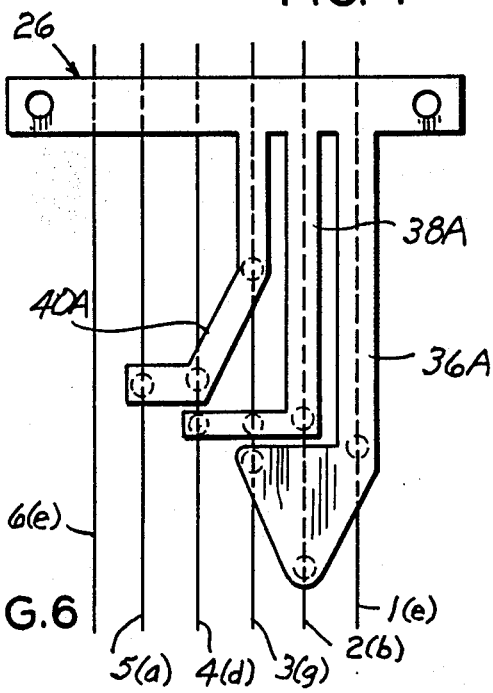

It seems obvious that the spring members and their planar plate-like terminal end portions may take other forms to obtain identical or different chords, as indicated by the numerals 36A, 38A and 40A (FIG. 6).

The chord forming plates A, D and G are each provided with a plurality of resilient material pads secured to their depending surface for depressing or stopping certain strings as follows: The D chord plate is provided with a pair of laterally spaced pads 42 and 44 respectively overlying strings 1(*e*) and 3(*g*) near the fret 14(*c*) on its side toward the tuning head 18. Similarly, a pad 46 is secured to the triangle apex portion of the plate D adjacent the fret 14(*c*) but opposite the pads 42 and 44.

The A chord plate is provided with an elongated bar-like resilient pad 48 adjacent the base of its triangular shape with the pad 48 transversely spanning the strings 2(*b*), 3(*g*) and 4(*d*) approximately midway between the frets 14(*b*) and 14(*c*).

The G chord plate is provided with a pad 50 adjacent the fret 14(*c*) at its side toward the tuning head 18 and at the juncture of the spring member 40 with its triangular plate G. The arm extension of the G plate is similarly provided with a pad 52 overlying the string 1(*e*). A pad 54 is similarly secured to the G plate over the string 6(*e*).

OPERATION

In operation, assuming the device 25 is connected with the instrument neck 10, as described hereinabove, the guitar player with his hand, not shown, gripping the neck in a conventional manner, may form a D chord by manually depressing, with one finger, the chord plate D so that the pads 42, 44 and 46 depress the strings 1(*e*), 2(*b*) and 3(*g*) so that the strings 1(*e*) and 3(*g*) are stretched or stopped over the fret 14(*c*) and the string 2(*b*) is stretched over the fret 14(*d*). Similarly, manually depressing, with one finger, the chord plate A stops the strings 2(*b*), 3(*g*) and 4(*d*) in contact with the fret 14(*c*) and forms an A chord. In like manner, a G chord is formed by one finger depression of the G plate in which the pads 50, 52 and 54 stops the string 5(*a*) on the fret 14(*c*) and the strings 1(*e*) and 6(*e*) on the fret 14(*d*).

It seems obvious that the apparatus 25 can be clamped at other positions longitudinally of the neck 10 for forming other music chords or that the use of the device is not limited to use with a guitar.

Obviously the invention is susceptible to changes or alterations without defeating its practicability. Therefore, I do not wish to be confined to the preferred embodiment shown in the drawings and described herein.

I claim:

1. A chord playing attachment for a musical instrument having a neck and having a plurality of strings extended longitudinally of the neck, comprising:

a unitary clamp means including a top bar having a planar top surface extending transversely of said neck and, integrally supporting a plurality of elongated planar spring members of uniform thickness projecting laterally of the top bar and extending longitudinally of the neck in string overlying cantilever juxtaposed fashion and generally parallel spaced relation, the top surface of each spring member normally lying in the plane of the top surface of said top bar, the terminal end portions of each said spring member extending transversely of said neck a distance at least overlying the position of at least three said strings;

a pad interposed between selected strings and said spring members and depending from the latter;

a clamp bottom bar extending transversely of said neck; and, screw means rigidly connecting said bars and impinging the strings against said neck and supporting the spring members in superposed spaced relation with respect to said strings, whereby pressing selected ones of said spring members toward the neck impinges the plurality of strings between the pads and the neck.

* * * * *